United States Patent [19]

Wolf et al.

[11] 4,108,936

[45] Aug. 22, 1978

[54] PROCESS FOR DYEING WET-SPUN AROMATIC POLYAMIDES IN GEL FORM

[75] Inventors: Gerhard Dieter Wolf; Ralf Miessen; Hans Egon Künzel, all of Dormagen; Francis Bentz, Cologne, all of Germany

[73] Assignee: Bayer Aktiengesellschaft, Leverkusen, Germany

[21] Appl. No.: 602,676

[22] Filed: Aug. 7, 1975

[30] Foreign Application Priority Data

Aug. 10, 1974 [DE] Fed. Rep. of Germany ..... 2438545

[51] Int. Cl.[2] ..... D06P 5/00; B01D 47/06

[52] U.S. Cl. ..... 264/78; 8/39 B; 8/41 B; 8/42 B; 8/85 B; 8/86; 8/162 S; 8/168 B; 8/171; 8/172 R; 8/172 A; 8/178 A

[58] Field of Search ..... 8/168 B, 178 A, 171, 8/172 R, 172 A, 85 B, 86; 28/75; 264/78

[56] References Cited

U.S. PATENT DOCUMENTS

| | | | |
|---|---|---|---|
| 2,558,733 | 7/1951 | Cresswell et al. | 264/182 |
| 3,111,357 | 11/1963 | Wirth | 8/55 |
| 3,233,019 | 2/1966 | Adams | 264/78 |
| 3,434,189 | 3/1969 | Buck et al. | 28/75 |
| 3,483,576 | 12/1969 | Nakagawa et al. | 8/177 |
| 3,506,990 | 4/1970 | Richardson et al. | 8/172 |
| 3,543,359 | 12/1970 | Whitaker | 28/72.16 |
| 3,602,966 | 9/1971 | Fleissner | 28/1.2 |
| 3,888,821 | 6/1975 | Milford | 260/45.8 NT |

FOREIGN PATENT DOCUMENTS 1,942,409 8/1970 Fed. Rep. of Germany.

*Primary Examiner*—Joseph L. Schofex
*Assistant Examiner*—A. L. Clingman
*Attorney, Agent, or Firm*—Plumley and Tyner

[57] ABSTRACT

The invention relates to a process for the production of dyed filaments from aromatic polyamides which are not modified with acid or basic groups.

10 Claims, No Drawings

PROCESS FOR DYEING WET-SPUN AROMATIC POLYAMIDES IN GEL FORM

This invention relates to a process for dyeing fully aromatic polyamides optionally containing heterocycles with cationic or anionic water-soluble dyes. The process according to the invention essentially comprises wet-spinning solutions of fully aromatic polyamides optionally containing heterocycles by conventional methods and dyeing the filaments obtained before, during or after stretching. in an aqueous bath containing a cationic or anionic dye.

The dyeing of wet-spun polyacrylonitrile polymers in "gel form" with water-soluble cationic dyes in an aqueous dye bath has been repeatedly described (U.S. Pat. No. 3,113,827; GB Pat. No. 991,957; U.S. Pat. No. 3,111,357; DT Pat. No. 1,494,628; U.S. Pat. No. 3,242,243). In order to guarantee a sufficiently deep and washproof dye finish, the acrylonitrile polymers or copolymers are modified with acid groups, preferably sulphonate groups.

However, it is known among experts that the dyeing of fully aromatic polyamides optionally containing heterocycles has hitherto proved difficult and expensive, even in cases where the polyamides have contained acid groups in order to improve their dyeability. According to one conventional process for dyeing aromatic polyamides, for example poly-m-phenylene isophthalamide, with cationic dyes, the following procedure is adopted:

The bath heated to 30° C, which is kept in constant circulation, has the following additions made to it:

40 g/l of benzaldehyde emulsion (the benzaldehyde emulsion is made up of 98 parts of benzaldehyde and 2 parts of a non-ionic emulsifier), 20% of sodium chloride (= 20 g/l of sodium chloride for a dye solution ratio of more than 1:20), 0.5% of a standard commercial-grade non-ionic surface-active dispersant, pH 4–4.5 buffered with trisodium phosphate or tetrasodium pyrophosphate.

The dissolved dye is then added and the temperature of the solution is increased over a period of 45 to 60 minutes to the required final dyeing temperature of 120° to 130° C (pressure vessel). Dyeing takes 1 to 2 hours. The dyeing process is completed by gradual cooling and rinsing.

In order to remove the benzaldehyde from the fibres, the dye finishes obtained have to be subjected to after-treatment under reducing conditions. To this end, the material is treated in a solution containing 2 g/l of conc. hydrosulphite, 0.5 g/l of a standard commercial-grade non-ionic surface-active dispersant, and trisodium phosphate or tetrasodium pyrophosphate to adjust the pH to a value of from 7 to 8.

The temperature of the treatment bath is 90° – 95° C and the treatment time is 10 minutes.

The treatment should be repeated after rinsing.

This proven "high-temperature process" for dyeing aromatic polyamides is extremely complicated, time-consuming and expensive.

Accordingly, it was extremely surprising to find that wet-spun filaments of aromatic polyamides optionally containing heterocycles can be given deep, washproof dye finishes in a simple, continuous process. It is particularly surprising that the aromatic polyamides or the aromatic polyamides containing heterocycles do not have to contain any acid groups. It is also remarkable that the quantity of dye taken up by the filaments in the dyeing process according to the invention can be greater than it is in the "high-temperature dyeing process" described above.

It is an object of this invention to provide a simple and continuous process for the production of dyed filaments of aromatic amides. Other objects will be evident from the following description and the Examples.

These objects are accomplished by a process for the production of dyed filaments from aromatic polyamides, which comprises dyeing wet-spun filaments of an aromatic polyamide, which optionally contains heterocyclic groups and which is not modified with acid or basic groups, before, during or after stretching, in an aqueous bath containing a cationic or anionic water-soluble dye.

Fully aromatic or aromatic polyamides or copolyamides containing heterocycles which may be dyed advantageously by the process according to the invention are described, for example, in the following Patent Specifications: U.S. Pat. Nos. 2,979,495; 3,006,899; 3,354,127; 3,380,969; 3,349,061; NE Pat. No. 6,809,916; GB Pat. No. 718,033; DT-OS No. 1,811,411; DT-OS No. 1,946,789.

Most of these aromatic polyamides or copolyamides optionally containing heterocycles are soluble in polar organic solvents, such as N,N-dimethyl formamide, N,N-dimethyl acetamide or N-methyl pyrrolidone, at least in cases where a few percent of an alkali or alkaline earth metal salt, such as calcium chloride or lithium chloride, are added as a solution promoter, and may readily be spun by the conventional wet-spinning process.

Cationic and anionic dyes may be used with particular advantage as the water-soluble dyes. A few dyes are identified by way of example in the following:

(A)

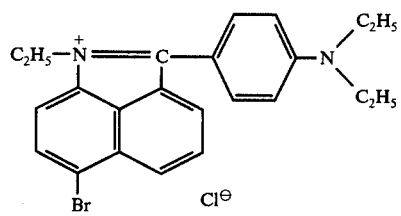

(B)

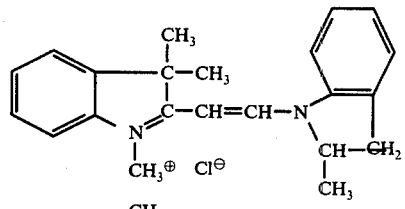

(C)

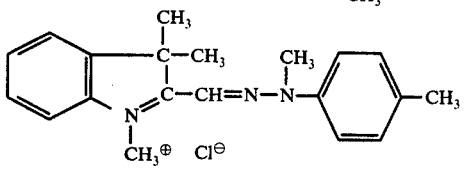

(D)

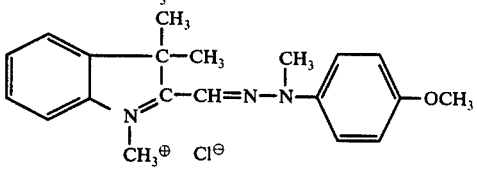

-continued
(E)
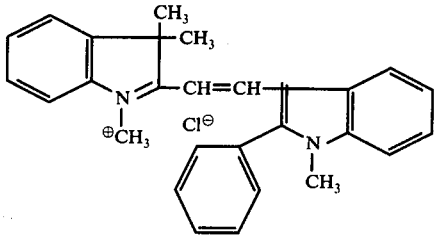
(F)
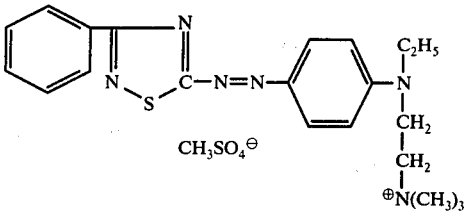
(G)
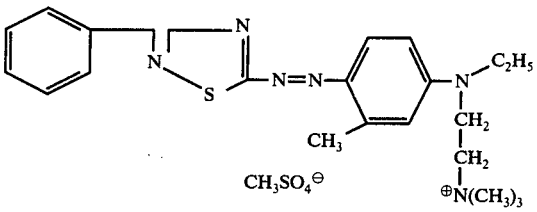
(H)
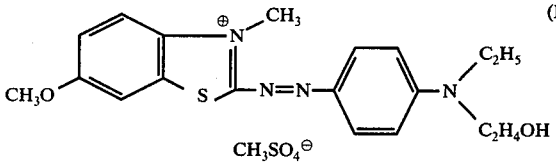
(J)
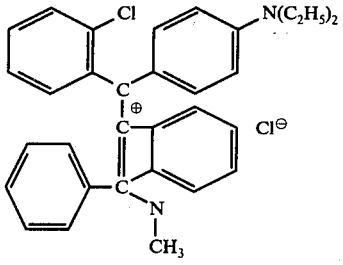
(K)
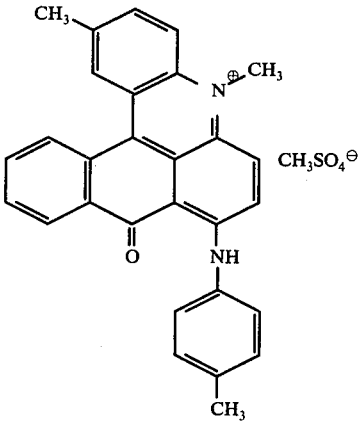
-continued
(L)
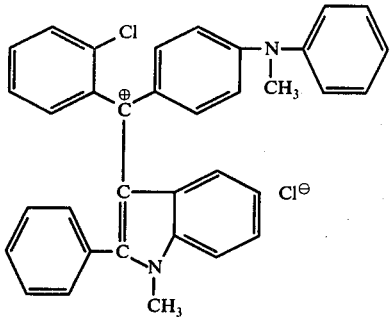
(M)
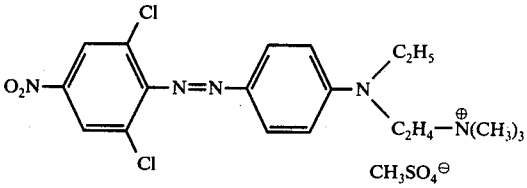
(N)
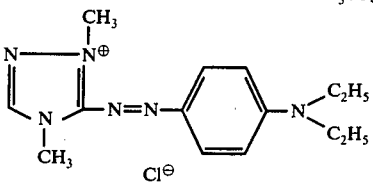
(O)
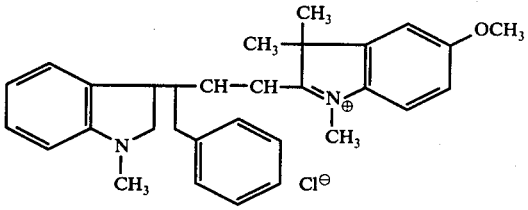
1 : 2 chromium complex of
(P)
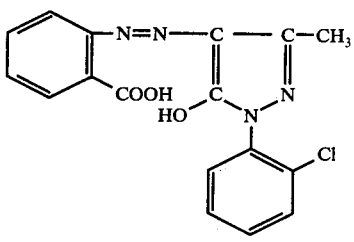
cobalt complex of
(Q)
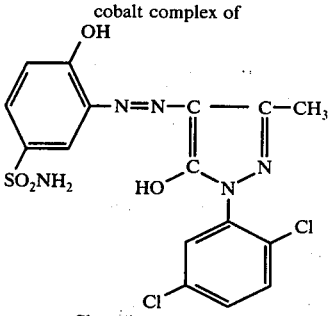
Chromium complex of
(R)
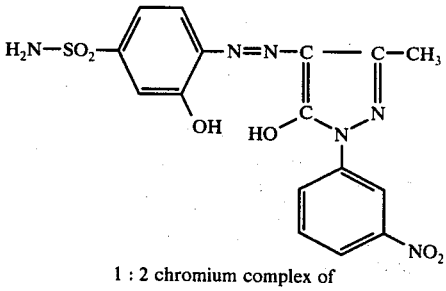
1 : 2 chromium complex of -continued (S)

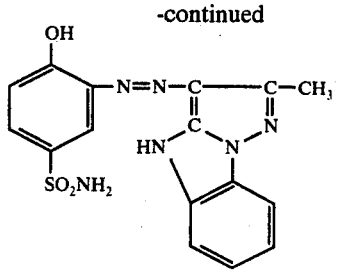

(T)

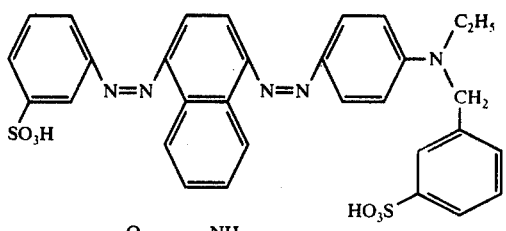

(U)

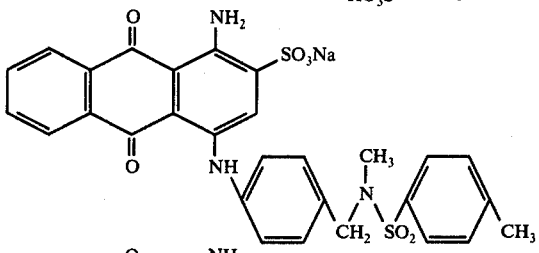

(V)

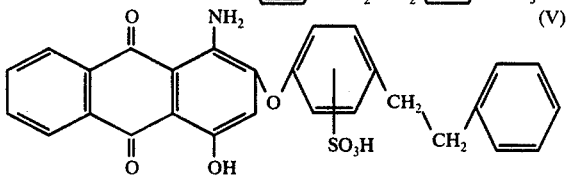

(W)

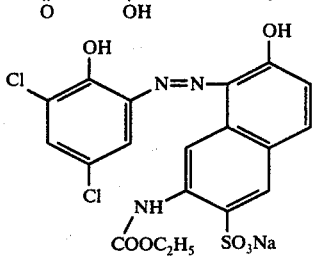

Dyeing of the filaments in the aqueous dye bath is preferably carried out before stretching, although it can also be carried out during or after stretching of the filaments.

The concentration of dye in the dye bath preferably amounts to between 0.01 and 5% and particularly to between 0.2 and 1% by weight. The temperature of the dye bath may be in the range of from 20° to 100° C, although it is preferably kept at 50° to 80° C.

In one preferred embodiment, from 1 to 40% by weight and preferably from 10 to 25% by weight (based on the total weight of the bath) of a polar organic solvent, for example dimethyl acetamide, N-methyl pyrrolidone, dimethyl formamide or hexamethyl phosphoric acid tris amide, is added to the aqueous dye bath. It is preferred to use the same solvent that is also used for preparing the spinning solution.

More particularly, the process is carried out as follows:

The polycondensation and the preparation of suitable spinning solutions of the polyamides are adequately described in the above-mentioned Patent Specifications.

Spinning is carried out by the conventional wet-spinning process in which individual spinning conditions may be varied within wide limits. It is advantageous to use spinning solutions with viscosities in the range of from 300 to 1100 poises at 20° C and with a solid polyamide concentration, corresponding to those viscosities, of from 13 to 25% by weight. The spinnerets used are 20–1000-bore spinnerets with a bore diameter of from 0.08 to 0.2 mm. The aqueous precipitation bath contains from 40 to 65% by weight (based on the total weight of the bath) of a polar organic solvent (preferably the spinning solvent) and is adjusted to a temperature of from 20° to 50° C. The take-off rate is advantageously from 4 to 8 meters per minute.

The coagulated filaments are introduced into an aqueous dye bath containing from 0.01 to 5% by weight and preferably from 0.2 to 1% by weight (based on the bath) of a cationic or anionic dye in dissolved form, either after washing in a water bath or directly, i.e. without washing. The bath is kept at a temperature of from 20° to 100° C and preferably at a temperature of from 50° to 80° C. The average residence time of the filaments is from 10 to 30 seconds. In one preferred embodiment of this process, the dye bath additionally contains from 1 to 40% by weight and preferably from 10 to 30% by weight (based on the total weight of the bath) of a polar organic solvent such as N-methyl pyrrolidone, dimethyl acetamide, dimethyl formamide or hexamethyl phosphoric acid tris-amide, but preferably the spinning solvent.

The filaments are then passed through an aqueous washing bath with a temperature in the range of from 20° to 80° C. The residence times in the washing bath are preferably from 10 to 60 seconds, although residence times of up to 5 minutes are also possible. After it has passed through the washing bath, the filament has a solvent content of less than 3% by weight.

The aftertreatment of the precipitated and washed filaments is governed by the chemical structure of the filaments and is described in the Patent Specifications quoted above. In general, it is best to subject the filaments to a two-stage stretching process, in which they are initially stretched in boiling water in a ratio of from 1:1.2 to 1:2.2, followed by stretching on a curved heating surface or on a godet at a temperature in the range of from 200° to 360° C, the stretching ratio in this second stage of the stretching process being from 1:2.0 to 1:8.0. The filaments thus obtained show the favourable textile properties which are specific to them and which are described in the Patent literature. In addition, they are given deep, washproof dye finishes by a simple, continuous process. Comparison of this gel-phase dyeing process with the conventional "high-temperature dyeing" process surprisingly shows that dyeing in the gel phase produces a deeper dye finish.

The depth of colour of the dyed filaments was determined by remission measurement in accordance with DIN 5033 in the standard colour values X, Y and Z.

The relative viscosities ($\eta_{rel.}$) quoted in the following Examples were measured on a 0.5% solution of the particular polymer in N-methyl pyrrolidone at 20° C.

In the following Examples, which are to further illustrate the invention without limiting it, all percentages are by weight unless other stated.

EXAMPLE 1

A 20% solution of an aromatic polyamide having the recurring units of the formula

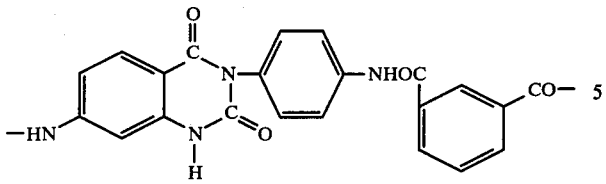

in dimethyl acetamide, which has a relative viscosity $\eta_{rel.}$ of 1.95, was spun at room temperature through a 50-bore spinneret (bore diameter 0.1 mm) into a precipitation bath consisting of 90 parts by weight of water and 10 parts by weight of dimethyl acetamide. The filaments were then introduced into a water bath containing 10 g/l of the yellow dye (P). The residence time of the filaments in this dye bath was 14 seconds. The dyed filaments were then washed and stretched in a ratio of 1:1.5 in boiling water. Final stretching in a ratio of 1:1.3 was carried out on a heating bar at 30° C. The filament yarn was found to have the following textile properties:
Strength: 4.0 - 4.3 g/dtex.
Elongation: 6 - 10%.

The fastness to washing and gloss of the filaments are excellent. Coloristic fastness to light: 5 - 6.

EXAMPLE 2

An approximately 18% by weight solution of the aromatic polyamide:

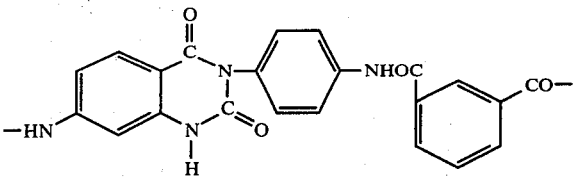

in dimethyl acetamide with a relative viscosity $\eta_{rel.}$of 2.05 was spun through a 50-bore spinneret (bore diameter 0.1 mm) into an aqueous precipitation bath containing approximately 5% of dimethyl acetamide. After brief washing in a water bath, the coagulated filaments were introduced into the dye bath containing 10 g/l of the blue dye (A). The residence time in the dye bath was 14 seconds. The dyed material was then washed and stretched in a ratio of 1:1.4 in boiling water. After final stretching in a ratio of 1:1.3 on a curved heating surface with a temperature of 300° C, the filament yarn was found to have the following textile properties:
Strength: 4.5 g/dtex.
Elongation: 9 - 11%.

The filaments had a deep washproof dye finish. Coloristic fastness to light: 4.

EXAMPLE 3

Following the procedure of Example 2, a solution of the aromatic polyamide used in Example 2 was spun and deeply dyed in a dye bath with the red dye (N). Textile properties:
Strength: 4.3 - 4.5 g/dtex.
Elongation: 10 - 13%.

The deep-red filaments are glossy and have an excellent fastness to washing. Coloristic fastness to light: 4.

EXAMPLE 4

Following the procedure of Example 3, a solution of the aromatic polyamide used in Example 2 was spun and again dyed with dye (N). In contrast to the dyeing conditions applied in Example 3, the dye bath had a temperature of 80° C instead of 20° C. Comparison of the two dye finishes (EXAMPLE 3 and EXAMPLE 4) showed that the filaments dyed at 80° C were dyed slightly more deeply.

EXAMPLE 5

The solution described in Example 2 of the aromatic polyamide containing a quinazolin dione system in dimethyl acetamide was spun and dyed in a dye bath (temperature 60° C) which contained 10 g/l of a mixture of the red dyes:

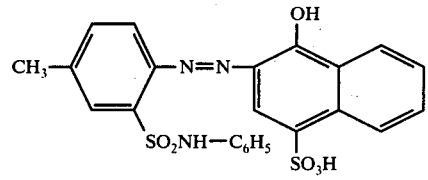

and

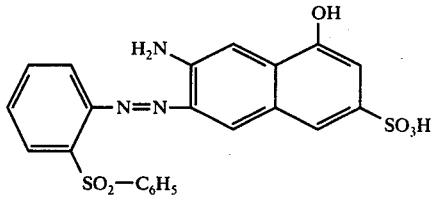

Residence time in the dye bath: 14 seconds. The filaments were prestretched in boiling water in a ratio of 1:1.7 and, after drying, were stretched to completion on a heating bar at 300° C in a ratio of 1:1.2.
Strength: 3.8 - 4.2 g/dtex.
Elongation: 8 - 10%. Colouristic fastness to light: 4.

EXAMPLE 6

A 21% solution of poly-(m-phenylene-isophthalamide) [$\eta$ = 1130 poises, $\eta_{rel.}$ = 1.85], which contained approximately 2% of calcium chloride as a solution promoter, was spun through a 50-bore spinneret (bore diameter 0.1 mm) into a precipitation bath (bath temperature 20° C) containing 90 parts by weight of water and 10 parts by weight of dimethyl acetamide. The take-off rate of the filaments was 5 meters per minute. After brief washing in a water bath, the filaments were introduced into a dye bath containing 10 g/l of dye (A). The residence time in the dye bath was about 15 seconds. The dyed filaments were then washed in boiling water and at the same time were initially stretched in a ratio of 1:1.8. Final stretching in a ratio of 1:1.2 was carried out after drying on a curved heating surface 30 cm long with a temperature of 300° C. The filament yarn was found to have the following textile properties:
Tensile strength: 2.9 - 3.5 g/dtex.
Elongation: 15 - 26%.

The filaments had a deep washproof dye finish.

The filaments dyed in the gel bath were found by remission measurement in accordance with DIN 5033 to have the following standard colour values X, Y and Z:
9.7 — 11.5 — 20.7

Filaments which, for comparison, had been subjected to high temperature dyeing were not so deeply coloured, as can be seen from the higher standard colour values X, Y and Z:
11.3 — 16.4 — 32.0

EXAMPLE 7

The poly-(m-phenylene-isophthalamide)-solution described in Example 6 was spun in the same way as in Example 6. The filaments obtained were then introduced into a dye bath which, in addition to the usual concentration of dye (A), additionally contained 20% by weight of dimethyl acetamide. After the 2-stage stretching process, filaments were obtained which were dyed more deeply than the filaments described in Example 6. Their textile properties were substantially the same.

EXAMPLE 8

The poly-(m-phenylene-isophthalamide)-solution described in Example 6 was spun in the same way as described in that Example and dyed in a dye bath which, in addition to the dye mixture described in Example 5, also contained 20% by weight of dimethyl acetamide. The residence time in the dye bath was approximately 15 seconds. The dyed filaments were stretched in a ratio of 1:2 in boiling water and, after drying, were stretched in a ratio of 1:1.2 on a curved heating surface with a temperature of 290° C.

Tensile strength: 3.2 – 3.7 g/dtex.

Elongation: 15 – 25%.

The filaments had a deep red washproof dye finish. Colouristic fastness to light: 4 – 5

EXAMPLE 9

The poly-(m-phenylene-isophthalamide)-solution described in Example 6 was spun and dyed in a dye bath containing 10 g/l of the red dye (N). The bath temperature was 95° C. The filaments were initially stretched in a ratio of 1:1.8 during the dyeing process. After washing and drying the filaments were finally stretched in a ratio of 1:1.3 on a curved heating surface with a temperature of 290° C.

Tensile strength: 3.1 – 3.6 g/dtex.

Elongation: 20 – 25%.

The filaments had a deep washproof dye finish. Coloristic fastness to light: 3 – 4.

The filaments dyed in the gel bath were found by remission measurement in accordance with DIN 5033 to have the following standard colour values X, Y and Z:

16.0 — 11.3 — 11.4

Filaments which, for comparison, had been subjected to high temperature dyeing were not dyed so deeply, as can be seen from the higher standard colour values X, Y and Z:

26.8 — 15.2 — 17.1

EXAMPLE 10

The poly-(m-phenylene-isophthalamide)-solution described in Example 6 was spun in the same way as described in that Example and dyed in a dye bath with dye (P). The stretched filaments had a deep washproof dye finish. Coloristic fastness to light: 5 – 6.

EXAMPLE 11

A 22% solution of an aromatic polyamide, prepared from tolylene-2,4-diamine and isophthalic acid dichloride, which had a viscosity of 1450 poises and a relative viscosity $\eta_{rel.}$ of 1.72, was spun through a 10-bore spinneret into an aqueous precipitation bath. The take-off rate was 5 meters per minute. The filaments were then introduced into an aqueous dye bath which contained approximately 20% by weight of dimethyl acetamide and 10 g/l of dye (P). After a residence time of approximately 14 seconds in the dye bath, the filaments were washed in boiling water and at the same time were initially stretched in a ratio of 1:1.5. Final stretching in a ratio of 1:5 was carried out after drying on a curved heating surface with a temperature of 300° C. Tensile strength: 2.6 – 3.2 g/dtex. Elongation: 10– 15% Coloristic fastness to light: 6.

EXAMPLE 12

The polyamide solution described in Example 11 was spun, dyed and aftertreated in the same way as described in that Example. The dye used was the dye mixture described in Example 5.

The filaments had a deep washproof dye finish. Coloristic fastness to light: 3 – 4.

EXAMPLE 13

The polyamide solution described in Example 11 was spun, dyed and aftertreated in the same way as in that Example. The dye used was the organe dye (O). The filaments had a deep washproof dye finish. Coloristic fastness to light: 3.

EXAMPLE 14

A solution of a copolyamide, obtained from 69 parts by weight of m-phenylene diamine, 36.2 parts by weight of 3-(p-aminophenyl)-7-amino-2,4-(1H,3H)-quinazolin dione and 152.2 parts by weight of isophthalic acid dichloride, in dimethyl acetamide had a viscosity of 1700 poises and a relative viscosity $\eta_{rel.}$ of 1.87. The solution was spun through a 50-bore spinneret into an aqueous precipitation bath. The take-off rate was 5 meters per minute. The filaments were then introduced into an aqueous dye bath which contained approximately 20% by weight of dimethyl acetamide and the dye (N). The bath temperature was 20° C. After a residence time in the dye bath of approximately 15 seconds, the filaments entered a boiling water bath in which they were washed and at the same time stretched in a ratio of 1:1.5. Final stretching in a ratio of 1:1.4 was carried out after drying on a curved heating surface with a temperature of 290° C. Tensile strength: 2.9 – 3.3 g/dtex. Elongation: 12%.

The filaments had a deep washproof dye finish. Coloristic fastness to light: 5 – 6.

EXAMPLE 15

The solution described in Example 14 of the aromatic copolyamide containing quinazolin dione units was spun, dried and aftertreated in the same way as described in Example 14. The dye (P) was used on this occasion. Coloristic fastness to light: 6.

What we claim is:

1. A process for the production of dyed filaments of aromatic polyamides which comprises continuously dyeing wet-spun gel filaments of an aromatic polyamide which is not modified with acid or basic groups before, during, or after stretching, in an aqueous bath containing at least one cationic or anionic water-soluble dye in dissolved form.

2. The process of claim 1, wherein the wet-spun filaments are dyed before stretching.

3. The process of claim 1, wherein the filaments are prestretched during dyeing in the aqueous dye bath.

4. The process of claim 1, wherein said aqueous dye bath contains from 0.01 to 5% by weight of dissolved dye.

5. The process of claim 1, wherein said aqueous dye bath is at a temperature in the range of from 20° to 100° C.

6. The process of claim 1, wherein said aqueous dye bath additionally contains from 1 to 40% by weight (based on the total weight of the bath) of a polar organic solvent.

7. The process of claim 6, wherein said polar organic solvent is a member selected from the group consisting of acetamide, N-methyl pyrrolidone, dimethyl formamide and hexamethyl phosphoric acid tris-amide.

8. The process of claim 1, wherein said aromatic polyamide is poly-m-phenylene isophthalamide.

9. The process of claim 1 wherein the aromatic polyamide further contains heterocyclic groups.

10. The process of claim 1, wherein said aromatic polyamide is a polyamide which is represented by the recurring units

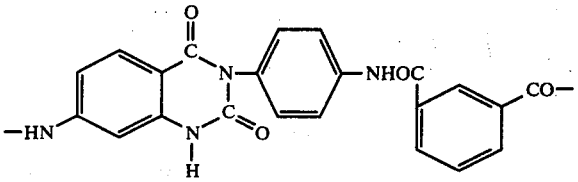

* * * * *